US008581155B2

(12) United States Patent
Leary et al.

(10) Patent No.: US 8,581,155 B2
(45) Date of Patent: Nov. 12, 2013

(54) AIRCRAFT WATER HEATING SYSTEM

(75) Inventors: John Leary, Yorba Linda, CA (US); Thomas J. Sievers, Laguna Niguel, CA (US); Ruth Li, Diamond Bar, CA (US); Kevin McHenry, Laguna Niguel, CA (US); Dane Immel, Newhall, CA (US); Tjeerd Jan De Jong, Yorba Linda, CA (US)

(73) Assignee: Adams Rite Aerospace, Inc., Fullerton, CA (US)

( * ) Notice: Subject to any disclaimer, the term of this patent is extended or adjusted under 35 U.S.C. 154(b) by 2229 days.

(21) Appl. No.: 10/664,699

(22) Filed: Sep. 18, 2003

(65) Prior Publication Data

US 2004/0057709 A1 Mar. 25, 2004

Related U.S. Application Data

(60) Provisional application No. 60/412,102, filed on Sep. 19, 2002.

(51) Int. Cl.
*H05B 1/02* (2006.01)

(52) U.S. Cl.
USPC ..... 219/535; 219/550; 392/392; 392/488; 392/407

(58) Field of Classification Search
CPC ..... H05B 1/02
USPC ..... 219/424, 535, 550; 392/314, 447, 481, 392/468, 467, 482, 486, 401, 407
See application file for complete search history.

(56) References Cited

U.S. PATENT DOCUMENTS

| | | | | | |
|---|---|---|---|---|---|
| 1,120,830 | A | * | 12/1914 | Mann | 392/481 |
| 1,420,840 | A | * | 6/1922 | Hewitt | 392/482 |
| 3,331,946 | A | | 7/1967 | Bilbro | |
| 3,711,681 | A | * | 1/1973 | Leuschner et al. | 392/467 |
| 3,949,189 | A | * | 4/1976 | Bilbro et al. | 392/468 |
| 4,152,577 | A | * | 5/1979 | Leavines | 392/468 |
| 4,300,442 | A | * | 11/1981 | Martin | 99/289 R |
| 4,446,158 | A | * | 5/1984 | English et al. | 426/79 |
| 4,795,885 | A | * | 1/1989 | Driggers et al. | 219/534 |
| 4,947,025 | A | * | 8/1990 | Alston et al. | 392/481 |
| 5,222,185 | A | * | 6/1993 | McCord, Jr. | 392/314 |
| 5,615,805 | A | * | 4/1997 | Yoncak | 222/146.5 |
| 5,798,504 | A | * | 8/1998 | Schwarzkopf | 219/550 |
| 6,043,466 | A | * | 3/2000 | Jenko et al. | 219/535 |
| 6,128,439 | A | | 10/2000 | Adar et al. | |
| 6,539,173 | B2 | * | 3/2003 | Chu | 392/486 |
| 6,628,894 | B2 | * | 9/2003 | Winter et al. | 392/447 |
| 6,683,283 | B2 | * | 1/2004 | Schmidt | 219/424 |

FOREIGN PATENT DOCUMENTS

| | | | |
|---|---|---|---|
| DE | 1 234 883 | | 2/1967 |
| DE | 3823 281 | A1 | 1/1990 |
| DE | 03823281 | * | 1/1990 |

(Continued)

OTHER PUBLICATIONS

European Search Report; dated Dec. 2, 2003.

*Primary Examiner* — Mark Paschall
(74) *Attorney, Agent, or Firm* — Knobbe, Martens, Olson & Bear, LLP

(57) ABSTRACT

An aircraft sink water heater includes an electric heater with coils engaging water tube coils. The system quickly heats a small volume of water in the tube coils, sufficient to wash a user's hands.

22 Claims, 2 Drawing Sheets

(56) References Cited

FOREIGN PATENT DOCUMENTS

| | | | |
|---|---|---|---|
| DE | 42 30 795 A1 | | 3/1994 |
| EP | 0 350 453 | | 1/1990 |
| EP | 350453 | * | 1/1990 |
| FR | 994.870 | | 11/1951 |
| FR | 2 685 602 | | 6/1993 |
| FR | 2 817 953 | | 6/2002 |
| GB | 2157815 | * | 10/1985 |

* cited by examiner

AIRCRAFT WATER HEATING SYSTEM

This application claims the benefit of U.S. Provisional Application No. 60/412,102, filed Sep. 19, 2002.

FIELD OF THE INVENTION

This invention relates to water heaters and particularly to an electric water heating system for an aircraft or other applications in which similar requirements and limitations exist.

BACKGROUND OF THE INVENTION

Heated water is customarily provided in commercial aircraft lavatories for hand-washing purposes. There are a number of requirements for such systems that place many limitations on the designs which can be satisfactorily employed. A suitable system should provide the needed heated water in as efficient manner as possible. The amount of electrical power needed for heating should be limited since aircraft attempt to minimize the amount so as to minimize the weight and cost of equipment. Likewise, the cost and weight of the water heating components should also be minimized. Related to costs, repair and replacement expenses are always of importance.

One widely used system accomplishes some of these goals but also has certain deficiencies. That system employs a tank containing two or more electrical heaters immersed in water. A major shortcoming of that system is that the water in contact with the heater is heated to a high temperature, possibly even boiling, with the undesirable consequence that calcification or other impurities form mineral deposits on the heater. Also this can be a concern due to overheating, creating a pressure vessel. The deposits are not good thermal conductors and hence additional power is required to heat the water. Further, the deposits hasten the need to replace the heaters or the entire unit. The container also has somewhat greater volume than is needed based upon usage analysis. The water heater containment vessel has to be designed and manufactured as a "pressure vessel" due to potential steam pressure. Additionally, unit cost is high.

SUMMARY OF THE INVENTION

Briefly stated, the invention provides a compact water heating system for intermittent, small volume usage, such as for aircraft wash basins or similar applications. The system employs a tube, preferably coiled, and an electric heater in good heat transfer relation with the tube. Since the volume demand is small and intermittent for typical aircraft wash basin usage, and the water temperature desired is relatively low, no large reservoir of high temperature water is needed.

DETAILED DESCRIPTION OF THE PREFERRED EMBODIMENTS

Figure 1:
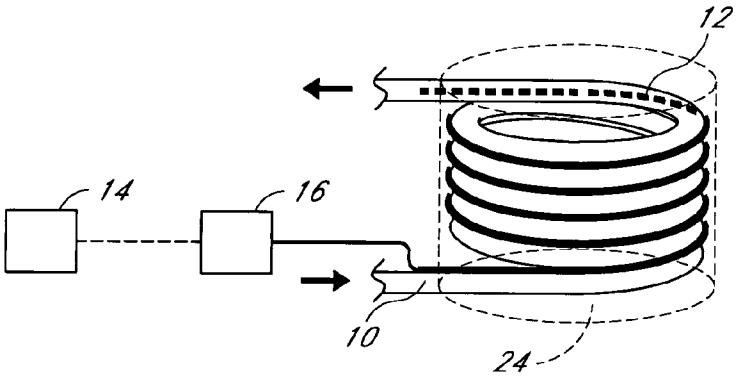
FIG. 1 is a schematic, perspective view of one embodiment of a water heater system.
Figure 2:
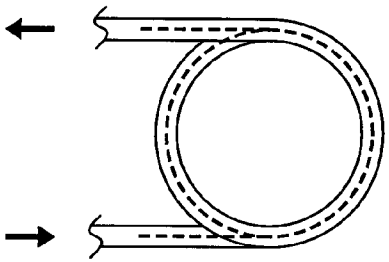
FIG. 2 is a plan view thereof.

Referring to FIG. 1, there is illustrated a water tube 10 coiled in a relatively tight spiral creating a series of coils. An electrical heater 12 adjoins the tube in good heat conductive fashion. For example, the heater may be brazed to the tube or joined by a good heat conductive epoxy. The heater preferably extends along most of the length of the tube coils to efficiently heat the water in the tube. The heater may be any readily available electric tubular heater having a resistance heating element surrounded by electrically insulating, heat conductive material. The heater is connected to a suitable source 14 of electric power, and a temperature responsive switch 16 to limit the maximum water temperature.

Figure 3:
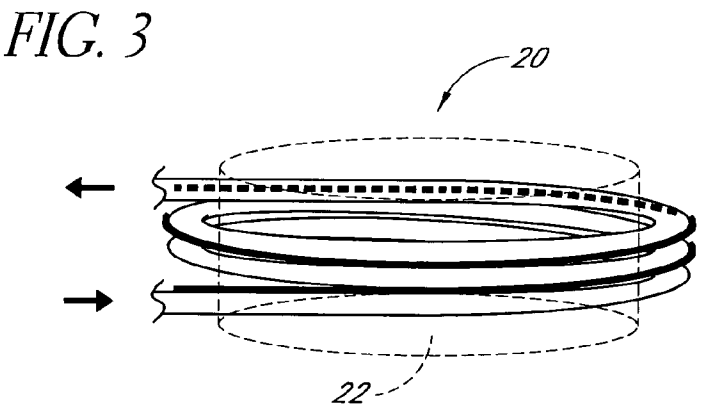
FIG. 3 is a schematic, perspective view of another embodiment of a water heater coiled around a sink basin.
Figure 4:
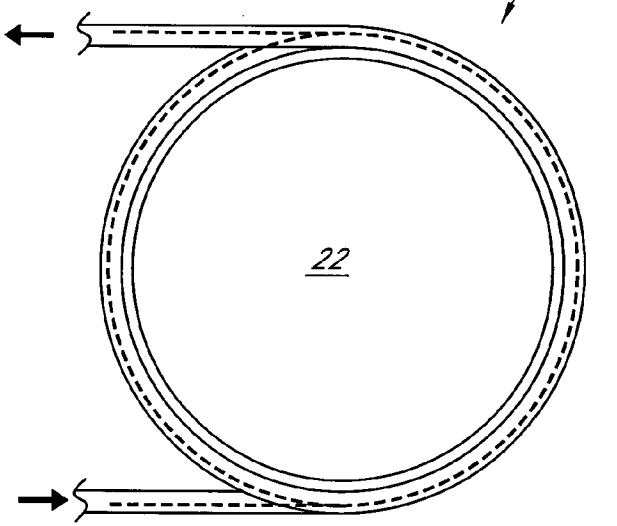
FIG. 4 is a plan view of the heater of FIG. 3.

The water tube is preferably made of copper or stainless steel or another thermal conducting and potable water compatible material. Stainless steel is a good thermal conductor. It is non-contaminating to water and is not corroded by water. Stainless steel is very durable, and is also very ductile so that it can be formed to fit into space-saving configurations. This, of course, is very important for aircraft usage where minimizing space needs is very important. The tightly curved tube illustrated in FIG. 1 is a relatively compact structure and does not take a large amount of space. For example, the coil diameter may only be three or four inches. On the other hand, because stainless steel or copper is easily formed, a heater 20 can be positioned around the lower portion of a sink basin 22, for example, as is illustrated in FIGS. 3 and 4, wherein the water heater may occupy space that is otherwise not used. The overall design is simple and long-lasting.

Another advantage of the system illustrated is that the length of tubing required is not very great in that the water usage demands are very low. Typically, aircraft lavatories have an automatic shut-off of the water supply 4 to 6 seconds after the user pushes the water dispensing button on the faucet. A typical user will push the button twice while washing hands to obtain two short bursts of water. In most aircraft systems, this is less than a pint and it is believed that only about 11 ounces is needed. It has also been found that a typical interval between users of an aircraft lavatory sink is seldom less than three minutes. In other words, it is only necessary to supply about 11 ounces of heated water about every 3 minutes.

Also, the system is not so much a hot water system as it is a warm water system. That is, the temperature of the water coming out of the tap for current systems is no more than about 115° F. It has been found that with the above-described heater, it is only necessary to employ a short length of tubing with the corresponding heater joined to it. The volume of water stored within the tube is sufficient to satisfy the needs without a separate storage container, that is, most of the heated water is depleted by a single user. That amount of unheated water is then heated to the necessary temperature within about three minutes. Note that the unheated water is typically already about 60° F.

More specifically, the parameters of a prototype system that satisfies typical aircraft needs employs about 74 inches of tubing with the corresponding length of electrical heater bonded to the tubing. The tubing external diameter is about ¾ inch while the tubing wall thickness is about 1/32 inch. The power required to heat 60° F. water to about 115° F. is approximately 400 watts. A system of that size provides about 14 ounces of water.

Minimizing electrical demands is of course also important on an airplane so as to minimize the cost and weight of power-generating equipment and to minimize the necessary fuel to produce the power. To further minimize electrical consumption and thermal losses, the heating coil may be insulated with a suitable lightweight insulating material. Further, the coil bundle can be encased in another enclosure 24 (FIG. 1) that helps conserve heat and protects the heater from its surroundings. The switch 16 and other electrical controls can be positioned within the coil bundle shown in FIG. 1.

Figure 6:
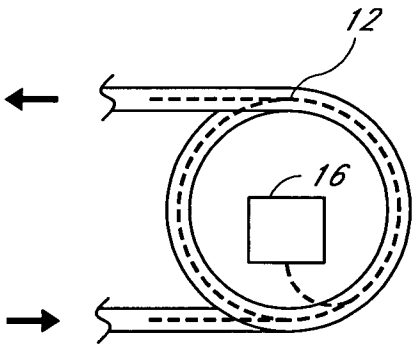
FIG. 6 is a plan view of the embodiment of FIG. 5.
Figure 5:
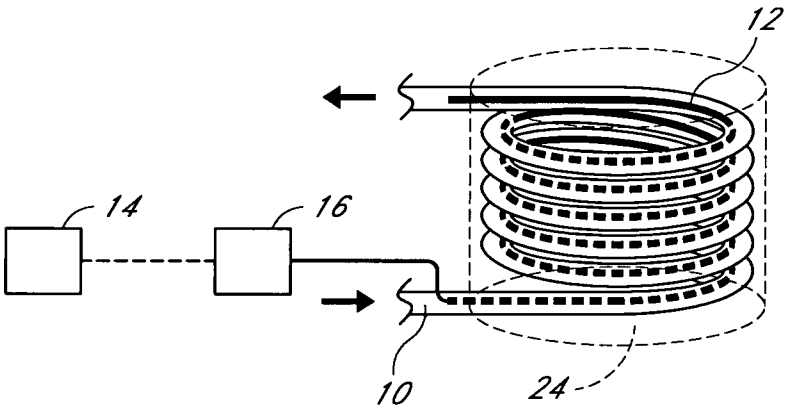
FIG. 5 is a schematic, perspective view of another embodiment of the invention.

The heater 12 is schematically illustrated in the drawings with each of its coils positioned in the recess formed between adjacent tube coils in intimate relation with those two coils. The heater coils are shown extending around the exterior of the tube coils, but the heater coils could be on the interior of the tube coils, as shown in FIG. 5. Also any electric controls could be positioned within the tube bundle, as shown in FIG. 6.

This heating system does not fall into the category of a "pressure vessel." Thus it results in a safe and economical approach.

This design promotes easy maintenance and cleaning. The water heater can be chemically cleaned in situ or can be cleaned with a brush without having to disassemble the water heater assembly.

While the invention has been shown and described with reference to a preferred embodiment, it will be understood by those skilled in the art that various changes in form and detail may be made therein without departing from the spirit and scope of the invention.

What is claimed is:

1. A water heating apparatus for use with a wash basin on an aircraft, the apparatus comprising:

a tube made of good heat conductive material, said tube comprising a plurality of coils with each coil engaging or being close to an adjacent coil;

an electric heater extending along a substantial length of said tube in good heat conductive relation with the tube, said heater being positioned exterior to said tube such that deposits do not form on said heater, said heater comprising coils with each heater coil being adjacent a pair of adjacent tube coils but not encircling an axis of said tube; and said substantial length of said tube defining a volume of less than that required to contain approximately 14 ounces of water such that a user on the aircraft can obtain a supply of heated water having a volume of less than approximately 14 ounces before the water heater begins heating a new supply of heated water.

2. The apparatus of claim 1, wherein the heater is brazed to the tube or joined to the tube with a heat conductive epoxy.

3. The apparatus of claim 1, wherein said tube has a circular exterior cross-section such that said sections create a recess between said sections, and said heater is positioned in said recess.

4. The apparatus of claim 1, wherein the heater coils are on the outside of the tube coils.

5. The apparatus of claim 1, wherein the heater coils are on the inside of the tube coils.

6. The apparatus of claim 1, wherein the tube and the heater define a tubular bundle of coils.

7. The apparatus of claim 1, wherein said tube and said heater are each formed with a plurality of coils which are sufficiently large to extend around the exterior of a lower portion of a wash basin.

8. The apparatus of claim 7, including the wash basin, wherein the wash basin is sized and configured for placement in the aircraft.

9. The apparatus of claim 1, wherein said heater configured to supply sufficient heat about 60° F. to about 115° F. in about three minutes.

10. The apparatus of claim 9, wherein said tube has an outer diameter of about ¾ of an inch and a length of about 74 inches.

11. The apparatus of claim 10, wherein said tube is made of copper or stainless steel.

12. The apparatus of claim 1, wherein said coil has an inlet and an outlet and said outlet is in fluid communication with said aircraft wash basin.

13. A method of heating small volumes of water for intermittent usage in a wash basin on an aircraft, said method comprising:

providing a tube to be connected to a water outlet, said tube being made of a good heat conductive material;

providing an electric heater in good heat conductive relation with the tube, said tube and said electric heater being in contact over a length that defines a volume of less than that required to contain approximately 14 ounces of water such that a user on the aircraft can obtain a supply of heated water having a volume of less than approximately 14 ounces before the water heater begins heating a new supply of heated water; and providing said tube and said heater with coils, said water heater coils being in good heat conductive relation with adjacent tube coils.

14. The method of claim 13 comprising:

applying electrical energy to the heater to heat less than about 14 ounces of water in said tube to at least about 115° F. in no more than about three minutes.

15. The method of claim 13, wherein said water outlet empties into said aircraft wash basin.

16. An aircraft sink water heater comprising a water tube, the water tube comprising an inlet and an outlet, the water tube comprising a spiral configuration to define a series of water tube coils, an electric heater comprising a spiral configuration to define a series of electric heater coils, the electric heater coils and the water tube coils having a common axis of curvature and each of the series of electric heater coils being in intimate relationship with only two adjacent coils of the water tube coils.

17. The aircraft sink water heater of claim 16, wherein the electric heater coils are positioned solely to the outside of the water tube coils.

18. The aircraft sink water heater of claim 16, wherein the electric heater coils are positioned solely to the inside of the water tube coils.

19. The aircraft sink water heater of claim 16, wherein the electric heater extends along substantially the entire length of the series of water tube coils.

20. The aircraft sink water heater of claim 16, wherein the water tube is formed of a potable water compatible material.

21. The aircraft sink water heater of claim 16, wherein the electric heater is insulated with a lightweight insulating material.

22. The aircraft sink water heater of claim 16 further comprising a temperature responsive switch positioned within the water tube coils, the temperature responsive switch being in electrical communication with the electric heater.

* * * * *